United States Patent [19]

Langevin

[11] Patent Number: 4,572,330

[45] Date of Patent: Feb. 25, 1986

[54] LADDER FOR BOARDING SMALL BOATS

[76] Inventor: Donald R. Langevin, 1739 SE. 46th La., Cape Coral, Fla. 33904

[21] Appl. No.: 739,341

[22] Filed: May 30, 1985

[51] Int. Cl.[4] ..... B63B 35/58; B63B 29/20; E06C 1/58

[52] U.S. Cl. ..... 182/206; 182/93; 182/129; 182/196; 441/39; 114/362

[58] Field of Search ..... 182/206, 93, 107, 108, 182/129, 196; 441/39; 114/362

[56] References Cited

U.S. PATENT DOCUMENTS

| | | | |
|---|---|---|---|
| 1,962,890 | 6/1934 | Berg | 182/196 |
| 2,764,766 | 10/1956 | Boyle | 182/196 |
| 2,975,858 | 3/1961 | Billingley | 182/196 |
| 3,155,992 | 11/1964 | Shewmake | 441/39 |
| 3,411,166 | 11/1968 | Kimmel | 182/206 |
| 3,633,708 | 1/1972 | Heilskov | 182/198 |
| 4,186,820 | 2/1980 | Cosman | 182/206 |
| 4,253,547 | 3/1981 | Skaalen | 182/196 |

*Primary Examiner*—Reinaldo P. Machado
*Attorney, Agent, or Firm*—Duckworth, Allen, Dyer & Pettis

[57] ABSTRACT

A boat ladder for boarding an inflatable pontoon boat, dinghy or similar small craft of the type having opposed generally parallel gunwales. The ladder has two generally parallel ladder supports, each with a first end bendable across one of the gunwales. Plural and parallel ladder steps extend between the two ladder supports and a strap is coupled at one end to the first end of both of the ladder supports. The strap is dimensioned to extend across the space between the gunwales. A hook extends about the second gunwale for coupling the other end of the strap to the other gunwale, whereby the weight of a person climbing up the ladder is distributed relatively evenly across both the gunwales.

7 Claims, 2 Drawing Figures

LADDER FOR BOARDING SMALL BOATS

BACKGROUND OF THE INVENTION

1. Field of the Invention

The present invention relates generally to ladders, and in particular relates to ladders which are specifically designed to permit the boarding of pontoon boats, dinghies or similar small craft.

2. Description of the Prior Art

A wide variety of ladder arrangements are known in the prior art. Some such ladder arrangements are specifically designed for use in boarding a small boat.

Examples of prior art ladder arrangements specifically designed for these purposes are the following: U.S. Pat. Nos. 1,962,890 to Berg; 2,764,766 to Boyle; 2,975,858 to Billingsley; 3,411,166 to Kimmel; 3,633,708 to Heilskov; and 4,253,547 to Skaalen.

Additionally, other prior art of interest may be found in Class 182, Subclasses 1, 82, 89, 150, 196 and 198 of the search records of the United States Patent and Trademark Office.

SUMMARY OF THE INVENTION

The present invention is directed to a boat ladder for boarding an inflatable pontoon boat, dinghy or similar small craft of the type having opposing, generally parallel gunwales. In the preferred embodiment of the present invention, the boat ladder includes two generally parallel ladder supports with each support having a first end bendable across one of the gunwales. Plural and parallel ladder steps extend between the two ladder supports, and a strap is provided for coupling at one end to the first end of both of the ladder supports, the strap being adjustable to extend across the space between the gunwales. Means are provided for coupling the other end of the strap to the other of the gunwales, whereby the weight of a person climbing up the ladder is relatively evenly distributed across both of the gunwales.

Further in accordance with the preferred embodiment, the coupling means comprises a hook engaging, and encircling a portion of the second gunwale. The strap may include one grab handle position between the two gunwales, so that the weight of a person climbing aboard is more evenly distributed.

The boat ladder of the present invention is useful in combination with a small boat as described above.

DESCRIPTION OF THE DRAWING

The present invention will be described with reference to the drawing, in which.

DESCRIPTION OF THE PREFERRED EMBODIMENT

The preferred embodiment of the present invention will now be described with reference to FIGS. 1 and 2.

Figure 1:
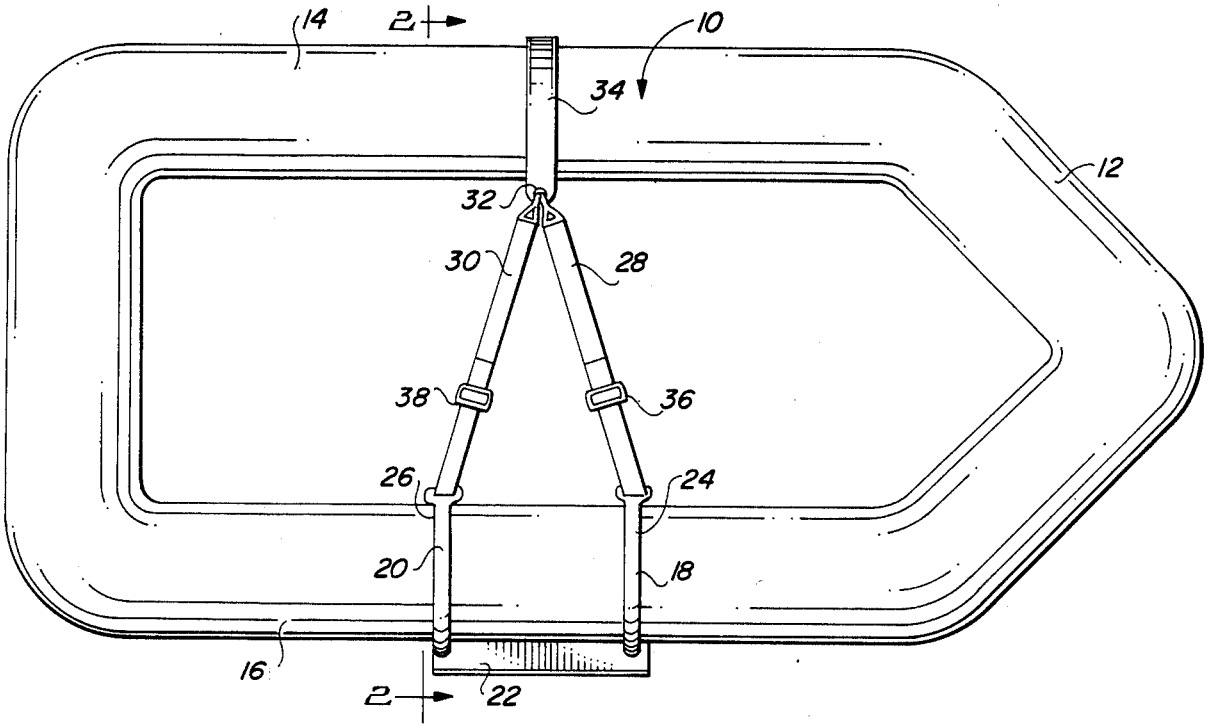
FIG. 1 is a top plan view of a boat and ladder combination in accordance with the present invention.
Figure 2:
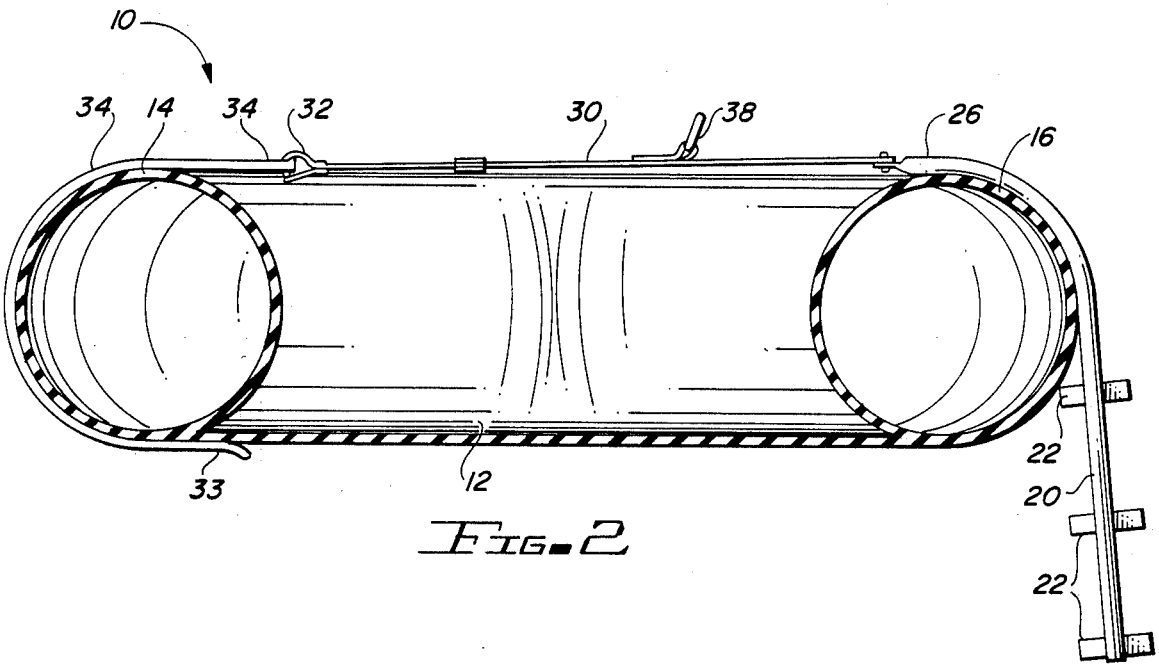
FIG. 2 is a cross-sectional elevation of the ladderboat combination shown in FIG. 1, taken along the line 2—2.

The combination of a small boat and boat ladder in accordance with this invention is referred to generally by the reference numeral 10 in FIGS. 1 and 2. The combination includes a small boat 12, such as an inflatable pontoon boat having a pair of gunwales 14, 16 defined by opposing pontoons. It will be understood from the description of the boat ladder arrangement set forth below that this arrangement is useful for other small boat designs as well.

The boat ladder includes two generally parallel ladder supports 18, 20, each support having a first end 24, 26, respectively which extends vertically along one of the gunwales 16. In the embodiment shown in FIGS. 1 and 2, the parallel ladder supports 18, 20 may be fabricated from aluminum tubing which is bent to extend across one of the inflatable pontoons 16, and alternataively may be fabricated from other materials so long as the material is sufficiently rigid to support the weight of the heaviest person who may be required to climb aboard using the ladder of the present invention. It will be further understood that ladder supports not utilizing the bend shown in FIGS. 1 and 2 may also be employed.

The ladder includes plural and parallel ladder steps 22 extending between the two ladder supports 18, 20. Two straps 28, 30 are coupled to the respective ones of the ends 24, 26 of the ladder supports 18, 20, and form a "V" configuration with a buckle 32 at the other end of the straps. The straps 28, 30 are adjustable to extend across the boat 12 toward the opposing gunwale 14.

In accordance with the present invention, means are provided for coupling the buckle end 32 of the straps 28, 30 to the opposite gunwale 14, in order that the weight of a person climbing up the ladder is distributed relatively evenly across both of the gunwales 14, 16. To this end, there is provided a hook 34 connected at one end 35 to the buckle 32, and extending around the gunwale 14 such that the other end 33 extends sufficiently about the gunwale 14 so as to insure that the hook 34 does not dislodge as a person is mounting the ladder steps 22. The hook 34 may constitute a metal or high tensile strength plastic material, and may assume various configurations in accordance with the specific needs of particular small boats.

Further in accordance with the present invention, there are provided grab handles 36, 38 on each of the straps 28, 30 to permit a person coming up the ladder steps 22 to pull himself across the gunwale 16 and thus more evenly distribute the person's weight between the gunwales 14, 16.

Various modifications and improvements may be made to the arrangement shown in FIGS. 1 and 2, without departing from the spirit and scope of the present invention.

I claim:

1. A boat ladder for boarding an inflatable pontoon boat, dinghy or similar small craft of the type having opposed and generally parallel gunwales, said boat ladder comprising:

two generally parallel ladder supports, each support having a first end thereof bendable across one of said gunwales;

plural and parallel ladder steps extending between said two ladder supports;

a strap coupled at one end to said first end of both of said ladder supports, said strap being adjustable to extend across the space between said gunwales; and means for coupling the other end of said strap to the other of said gunwales, whereby the weight of a person climbing up said ladder is distributed across both of said gunwales.

2. The boat ladder recited in claim 1 wherein said coupling means comprises a hook engaging and encircling a portion of the other of said gunwales.

3. The boat ladder recited in claim 1 further comprising at least one grab handle on said strap.

4. The boat ladder recited in claim 3 wherein said grab handle is spaced along said strap between said ends thereof, whereby the weight of a person climbing said ladder is more evenly distributed across both of said gunwales.

5. The boat ladder recited in claim 1, wherein said strap is formed of first and second strap portions forming a "V" with each of said first and second strap portions attached to an end of one of said ladder supports.

6. The boat ladder recited in claim 5, wherein said coupling means comprises a hook engaging and encircling a portion of the other of said gunwales, said boat ladder further comprising an adjusting buckle between said hook and said strap in order to permit adjustments of said strap for varying dimensions between said gunwales.

7. In combination:

a boat having first and second opposing gunwales;

two generally parallel ladder supports, each support having a first end thereof extending along one of said gunwales;

plural and parallel ladder steps extending between said two ladder supports;

a strap coupled at one end to said first end of both of said ladder supports, said strap being adjustable to extend across the space between said gunwales; and a hook coupled with said strap and engaging and encircling a portion of the other of said gunwales, whereby the weight of a person climbing up said ladder is distributed across both of said gunwales.

* * * * *